US007372000B2

(12) United States Patent
Stockley

(10) Patent No.: US 7,372,000 B2
(45) Date of Patent: May 13, 2008

(54) AIR CONTROL FOR A BRICK OVEN

(75) Inventor: Edward E. Stockley, Plano, TX (US)

(73) Assignee: Stockley Enterprises, LLC, Dallas, TX (US)

( * ) Notice: Subject to any disclaimer, the term of this patent is extended or adjusted under 35 U.S.C. 154(b) by 309 days.

(21) Appl. No.: 11/029,754

(22) Filed: Jan. 5, 2005

(65) Prior Publication Data

US 2005/0224064 A1 Oct. 13, 2005

Related U.S. Application Data

(60) Provisional application No. 60/561,730, filed on Apr. 13, 2004.

(51) Int. Cl.
*F24C 15/32* (2006.01)
*A21B 1/26* (2006.01)

(52) U.S. Cl. ..... 219/400; 219/392; 219/395; 219/399; 99/474; 126/21 A

(58) Field of Classification Search ..... None
See application file for complete search history.

(56) References Cited

U.S. PATENT DOCUMENTS 3,908,749 A 9/1975 Williams (Continued)

FOREIGN PATENT DOCUMENTS

FR 2485168 A * 12/1981

(Continued)

OTHER PUBLICATIONS

Notification Concerning Transmittal of Copy of International Preliminary Report on Patentability (1 page), International Preliminary Report on Patentability (1 page), Written Opinion of the International Searching Authority (3 pages) for International Application No. PCT/US2005/012257 mailed Oct. 25, 2006.

*Primary Examiner*—J. Pelham
(74) *Attorney, Agent, or Firm*—Fish & Richardson P.C.

(57) ABSTRACT

A food cooking oven has a front door, a back wall opposite the front door, and two side walls connecting the front door to the back wall. The oven also has a rear divider parallel to and spaced apart from the back wall, the rear divider running between the side walls and having a support bracket at a lower edge. The rear divider has a fan inlet. Side brackets are located along each side wall of the oven, each side bracket spaced evenly from the side wall to allow controlled amounts of air to flow between each side wall and each adjacent bracket. A solid cooking surface is adapted to be supported by the support bracket on the lower edge of the rear divider and the side brackets. A lower heating element is positioned below the solid cooking surface and spaced evenly from the solid cooking surface. A fan is positioned between the rear divider and the back wall, the fan is adapted to draw air through the fan inlet in the rear divider and push the air onto the lower cooking element.

24 Claims, 4 Drawing Sheets

U.S. PATENT DOCUMENTS

| | | | | |
|---|---|---|---|---|
| T973,013 | I4 | | 8/1978 | Ferrara et al. |
| 4,437,396 | A | | 3/1984 | Plattner et al. |
| 4,455,924 | A | | 6/1984 | Wenzel |
| 5,241,947 | A | | 9/1993 | Sandolo |
| 5,365,833 | A | | 11/1994 | Chen |
| 5,695,668 | A | * | 12/1997 | Boddy ..... 219/400 |
| 5,816,234 | A | | 10/1998 | Vasan |
| 6,041,769 | A | | 3/2000 | Llodra, Jr. et al. |
| 6,114,663 | A | | 9/2000 | Stockley |
| 6,250,210 | B1 | | 6/2001 | Moreth |
| 6,307,185 | B1 | * | 10/2001 | Loveless ..... 219/400 |
| 6,355,914 | B1 | | 3/2002 | Stockley |
| 6,382,085 | B1 | | 5/2002 | Dotan |
| 6,425,388 | B1 | | 7/2002 | Korinchock |
| 6,576,874 | B2 | | 6/2003 | Zapata et al. |
| 6,805,112 | B2 | | 10/2004 | Cole et al. |
| 2004/0040950 | A1 | | 3/2004 | Carbone et al. |

FOREIGN PATENT DOCUMENTS

| | | | |
|---|---|---|---|
| JP | 57161428 | | 10/1982 |
| JP | 61-153320 A | * | 7/1986 |

* cited by examiner

AIR CONTROL FOR A BRICK OVEN

This application claims the benefit of U.S. Provisional Application No. 60/561,730, filed Apr. 13, 2004.

TECHNICAL FIELD

This invention relates to ovens, and more particularly to ovens for quickly cooking food.

BACKGROUND

It is desirable to cook foods quickly while also obtaining a proper texture in the foods after cooking. Standard ovens and brick ovens may impart a desirable texture to food, but such ovens may take longer than desired. Microwave ovens are known for fast cooking, but bread dough and other foods do not achieve proper texture when cooked in a microwave. Convection ovens may achieve the proper texture for some foods and are quicker than standard ovens, but are not fast enough for walk-up service as in a convenience store or fast food restaurant. Additionally, rapid-cooking ovens often result in cooked food items that are cooked unevenly due to the high temperatures used and the lack of adequate circulation.

As an example, there are no commercial ovens known that can cook a raw pizza of standard size from a raw state to a properly browned and crisp state in less than four minutes.

SUMMARY

A food-cooking oven has a front door, a back wall opposite the front door, and two sidewalls connecting the front door to the back wall. The oven also has a rear divider parallel to and spaced apart from the back wall, the rear divider running between the sidewalls and having a support bracket at a lower edge. The rear divider has a fan inlet. Side brackets are located along each sidewall of the oven, each side bracket spaced evenly from the sidewall to allow controlled amounts of air to flow between each sidewall and each adjacent bracket. A solid cooking surface is adapted to be supported by the support bracket on the lower edge of the rear divider and the side brackets. A lower heating element is positioned below the solid cooking surface and spaced evenly from the solid cooking surface. A fan is positioned between the rear divider and the back wall, the fan is adapted to draw air through the fan inlet in the rear divider and push the air onto the lower cooking element.

Additional implementations may include a plurality of upper heating elements, a plurality of solid cooking surfaces, and/or a plurality of lateral deflectors. Additionally, one or more longitudinal deflectors may be disposed between two or more upper heating elements to deflect radiant heat emitted from the upper heating elements. In one or more implementations, multiple fans may draw air through multiple inlets through multiple interior portions of the oven.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
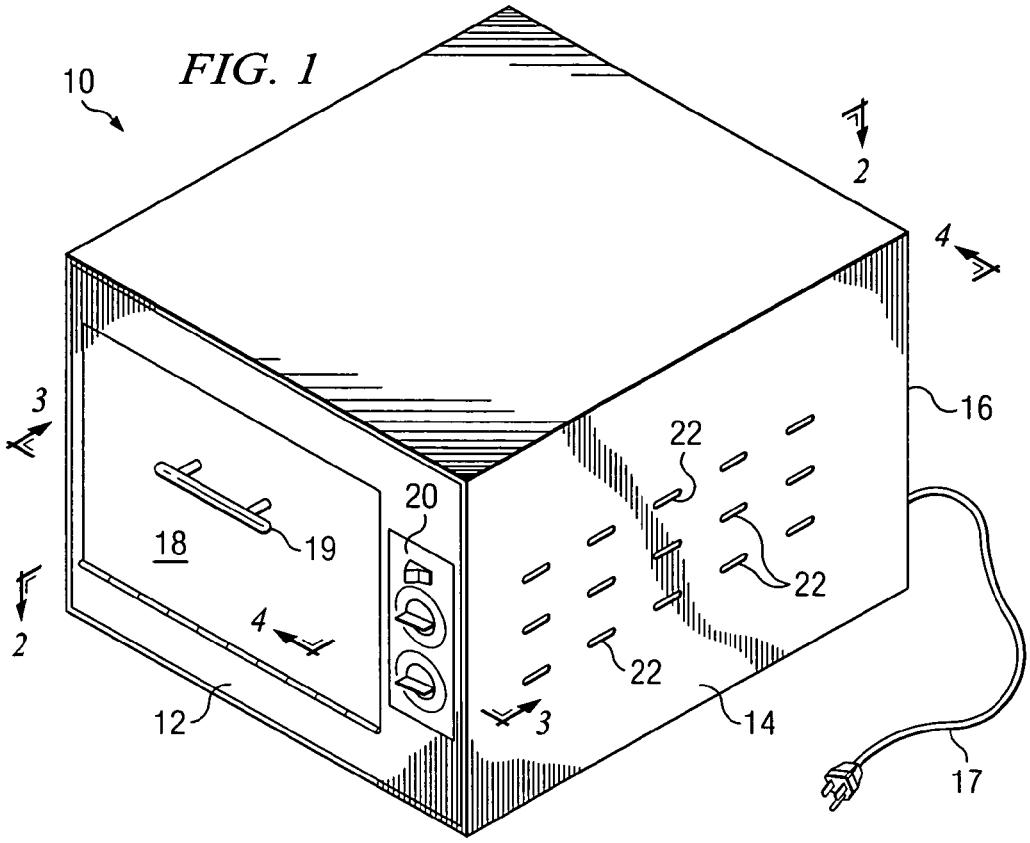
FIG. 1 is an isometric view of a convection brick oven.

As shown in FIG. 1, an oven 10 has housing that includes a front 12, sides 14, and a back 16. On the front 12 is a door 18 with a handle 19, and a control panel 20. On the sides 14 are side vents 22. A power cord 17 may be disposed through the back 16 (shown) or the sides (not shown), to provide electricity to the oven 10. The power cord 17 and the oven 10 may be adapted to operate at any suitable voltage, such as 110V, 220V, or other suitable voltage.

The oven 10 may be of varying proportions with sufficient interior dimensions to include the various aspects included in differing implementations. Additionally, the oven 10 may be constructed of various suitable materials. For example, the oven 10 may be constructed of various metals and/or metal alloys, such as aluminum, steel, stainless steel, or other suitable metal and/or metal alloy. Additionally, or alternatively, the oven 10 may be constructed of a ceramic material, heat-resistant polymers, nylons, or other olefin resins. The oven 10 may also contain various components manufactured from any number of materials in a given implementation. Various implementations may provide for cooking food items of varying sizes. For example, the oven 10 may be appropriately sized to cook various sizes of pizzas, calzones, breads, crusts, or other food products.

Figure 2A:
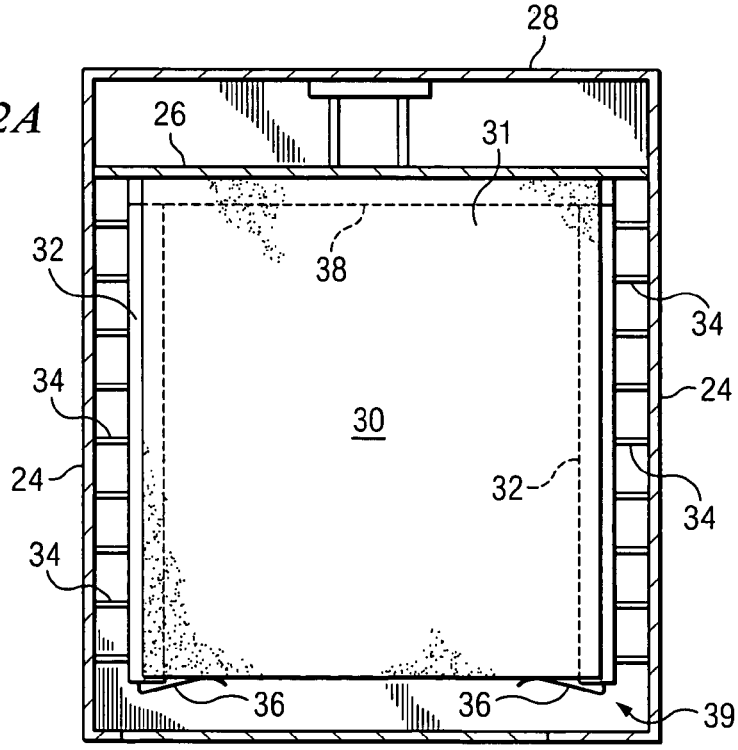
FIG. 2A is a sectional plan view of the oven of FIG. 1 along an axis defined by 3-3.

FIG. 2A illustrates the oven 10 having interior sidewalls 24, a rear divider 26, a back wall 28, and a solid cooking surface 30. The solid cooking surface 30 has a top side 31 and a bottom-side 33 (shown in FIG. 4), and may be a natural substance, such as a milled stone or baker's stone or a metal. Solid cooking surface 30 may be a brick, ceramic, metallic, composite or some other solid material. The material must be able to withstand high heat over a long period of time and provide a good cooking surface. Alternatively, the solid cooking surface 30 may be a manufactured substance such as a ceramic, metal alloy, or other suitable manufactured substance. In various implementations, the solid cooking surface 30 exhibits uniform heating properties that facilitate the even distribution of heat, so that when the solid cooking surface 30 is exposed to a heat source, the solid cooking surface 30 distributes the heat in a substantially even manner throughout the top-surface 31 of the solid cooking surface 30.

Figure 2B:
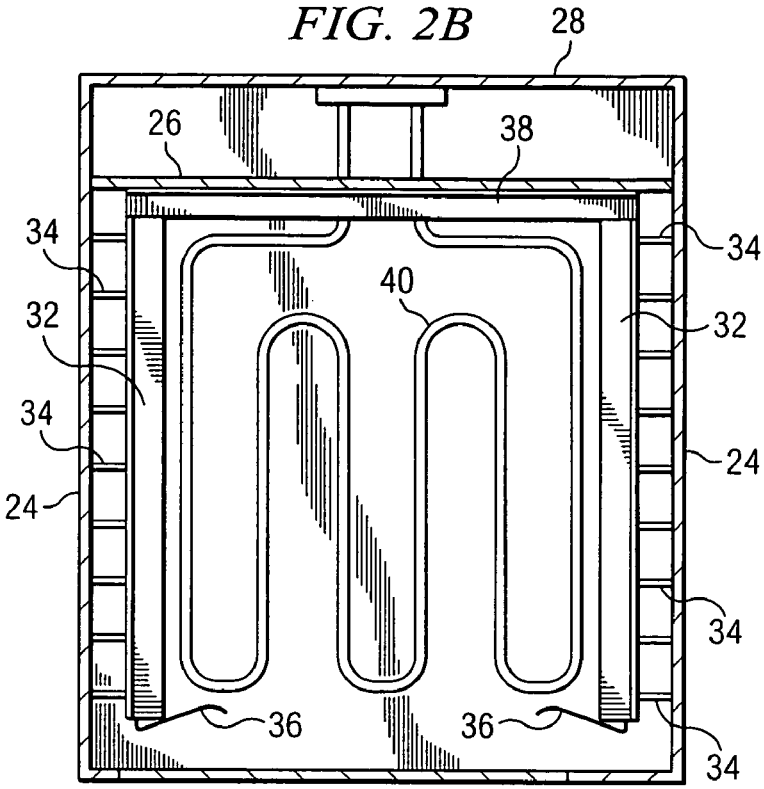
FIG. 2B is the same view along the axis 2-2 as FIG. 2 with the cooking brick removed to show details obscured by the brick

FIG. 2B illustrates a sectional plan view of the oven 10 along the line 3-3 with the solid cooking surface 30 removed. Side brackets 32 are coupled to the interior side walls 24 and support the solid cooking surface 30. The side brackets 32 may be spaced from the interior side walls 24 by support pins 34. Alternatively, the side brackets 32 may be supported by the support pins 34 in a manner in which the support pins 34 are coupled to the interior side walls 24, and the side brackets 32 rest on the support pins 34. Other suitable fasteners (not shown) may be used in various implementations to secure the side brackets 32 to the interior walls 24, such as screws or clips, etc. The side brackets 32 are spaced from the interior side walls 24.

The side brackets 32 may also have front springs 36 to help secure solid cooking surface 30 against rear divider 26. In alternate implementations, other devices may be used to secure the solid cooking surface 30 within the interior 39 of the oven 10 against the rear divider 26, such as brackets, or clips (not shown). The rear divider 26 may also have a rear support or shelf 38 to further support the solid cooking surface 30. The rear shelf 38 may be coupled to the rear divider 26 and/or the side brackets 38 to provide stability to the solid cooking surface 38 when the solid cooking surface 30 is placed in the interior 39 of the oven 10.

Rear shelf 38 and side brackets 32 are designed to allow some movement of solid cooking surface 30 while maintaining a fixed area of airflow both in front of the solid cooking surface 30 and on the sides of the solid cooking surface 30.

Figure 3:
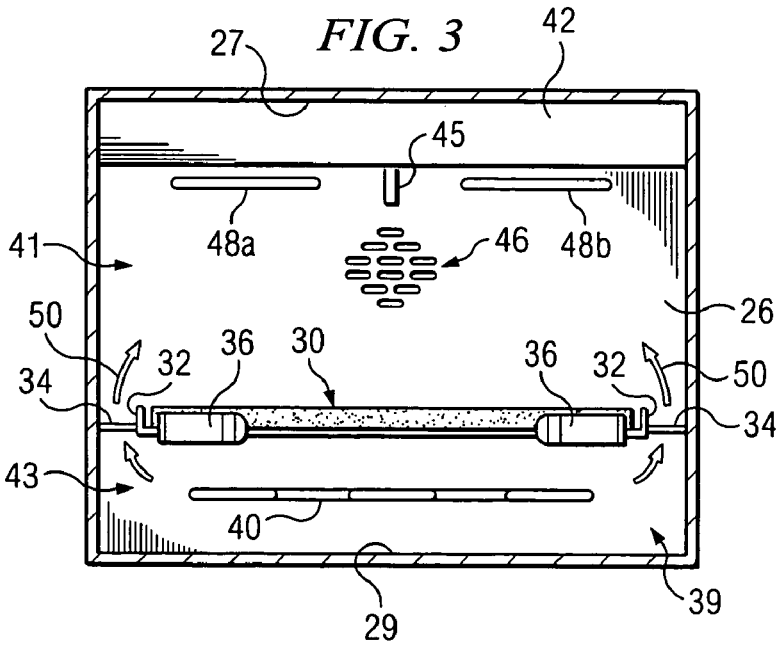
FIG. 3 is a sectional front view of the oven of FIG. 1.
Figure 4:
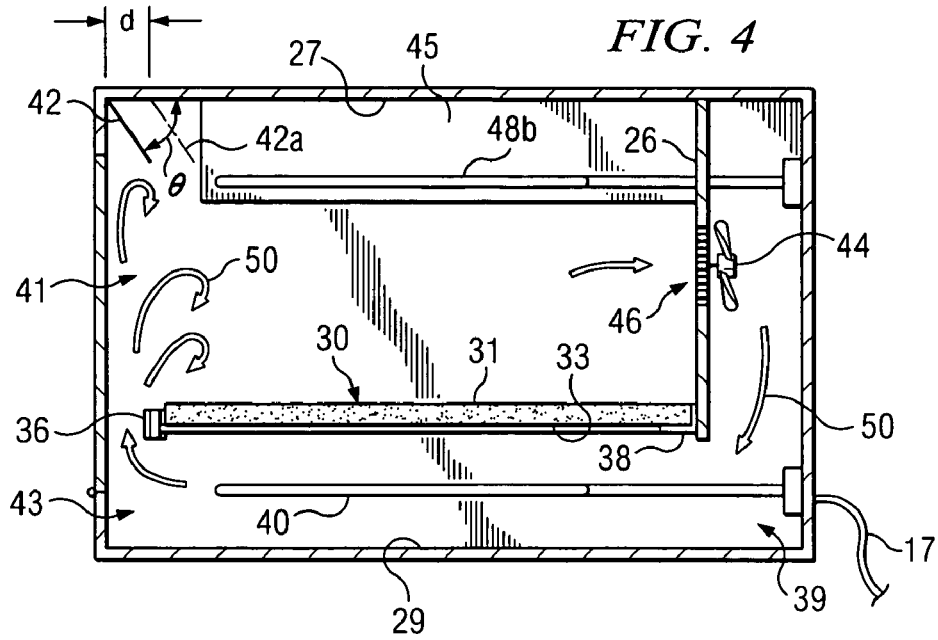
FIG. 4 is a sectional side view of the oven of FIG. 1.

As can be seen in FIGS. 2B, 3, and 4, a heating element 40 is positioned below the solid cooking surface 30 and spaced between the solid cooking surface 30 and an oven floor 29. The lower heating element may exhibit numerous configurations. For example, the lower heating element 40 may be circular, elliptical, serpentine, or other suitable configuration. Also visible in FIGS. 3 and 4 is a front deflector 42 or 42*a* which may extend downward at an angle θ from an upper position on the front interior of the oven 10. The front deflector 42 may extend from the intersection of the oven ceiling 27 and the interior wall of front 12 of the oven 10 near where the oven door 18 is positioned adjacent to or near the oven ceiling 27. Alternatively, a front deflector 42*a* may extend downward from the oven ceiling 27 at an angle θ. The front deflector 42*a* is displaced a distance "d" from the interior front of the oven 10.

Additionally, a longitudinal deflector 45 may be coupled to the oven ceiling 27 and/or the rear divider 26. Upper heating elements 48*a* and 48*b* may be positioned between the solid cooking surface 30 and an oven ceiling 27 to provide additional radiant heat to items being cooked in the oven 10. The upper heating elements 48 may be configured as circular, elliptical, serpentine, or other suitable configuration. The longitudinal deflector 43 provides a radiant barrier between the upper heating elements 48*a* and 48*b*. Accordingly, multiple food items may be placed on solid cooking surface 30 and be cooked at different temperatures based on different heat settings used for the upper heating elements 48*a* and 48*b*.

A fan 44 is positioned near a fan inlet 46, which may be a vent disposed in the rear divider 26. The fan inlet 46 may be voids in the surface of the rear divider 26, a separate vent placed in a suitable opening in the rear divider 26, or other suitable inlet operable to communicate an airflow from one side of the rear divider 26 to the other side of the rear divider 26. In addition to radiant heat, the upper heating elements 48*a* and 48*b* may provide some additional heat to air flowing through the oven 10 as a result of the circulation provided by the fan 44.

When fan 44 is activated air is circulated in the oven 10 as generally shown by arrows 50. Air within the oven interior 39 is pulled in through the fan inlet 46 to be pushed down between the rear divider 26 and interior back wall 28 of the oven 10. The air is forced to a lower interior portion 43 containing the lower heating element 40. The lower heating element 40 heats the air as the air flows under the solid cooking surface 30 through the lower interior portion 43 to create a convection flow within the oven.

As the air is pushed toward the front of the oven 10, a controlled amount of air is allowed to flow up between the side brackets 32 and the side walls 24. The amount of air allowed to flow between the side brackets 32 and the side walls 24 is not changed if the solid cooking surface 30 shifts within the side brackets 32, due to the spacing of the side brackets 32 from the oven side walls 24. Another portion of the airflow reaches the front of the solid cooking surface 30 and flows up between the door 18 and the solid cooking surface 30. The space between the front of the solid cooking surface 30 and the door 18 is controlled by front springs 36 which push the solid cooking surface 30 against the rear divider 26, thus providing a consistent space even if the solid cooking surface 30 is moved laterally between the side walls 24. Even if the solid cooking surface 30 shifts its position on the side brackets 32, the portion of the side brackets 32 that extend underneath the solid cooking surface 30 to hold the solid cooking surface 30 into place extend a sufficient distance beneath the solid cooking surface 30 to prevent any space between the side brackets 32 and the solid cooking surface 30. Thus the air flow is directed in a substantially controlled manner through the spaces between the side walls 24 and door 18 and the solid cooking surface 30 from the lower interior portion 43 and the upper interior portion 41. Thus, the only space between the solid cooking surface and the lower interior portion 43 and the upper interior portion 41 is via the spaces between the side brackets 32 and the side walls 24 and the space between the door 18 and the solid cooking surface 30.

As the bulk of the airflow is directed up between the door 18 and the solid cooking surface 30, the deflector 42 may interrupt the air flow, as shown by arrows 50 in FIG. 4. Without deflector 42 the airflow will not be in contact with the top surface 31 of solid cooking surface 30 and relatively cool regions could develop at various locations on the top surface 31 of the solid cooking surface 30. The deflector 42 or 42*a* facilitates the airflow over the entire top surface 31 of the solid cooking surface 30.

Figure 5A:
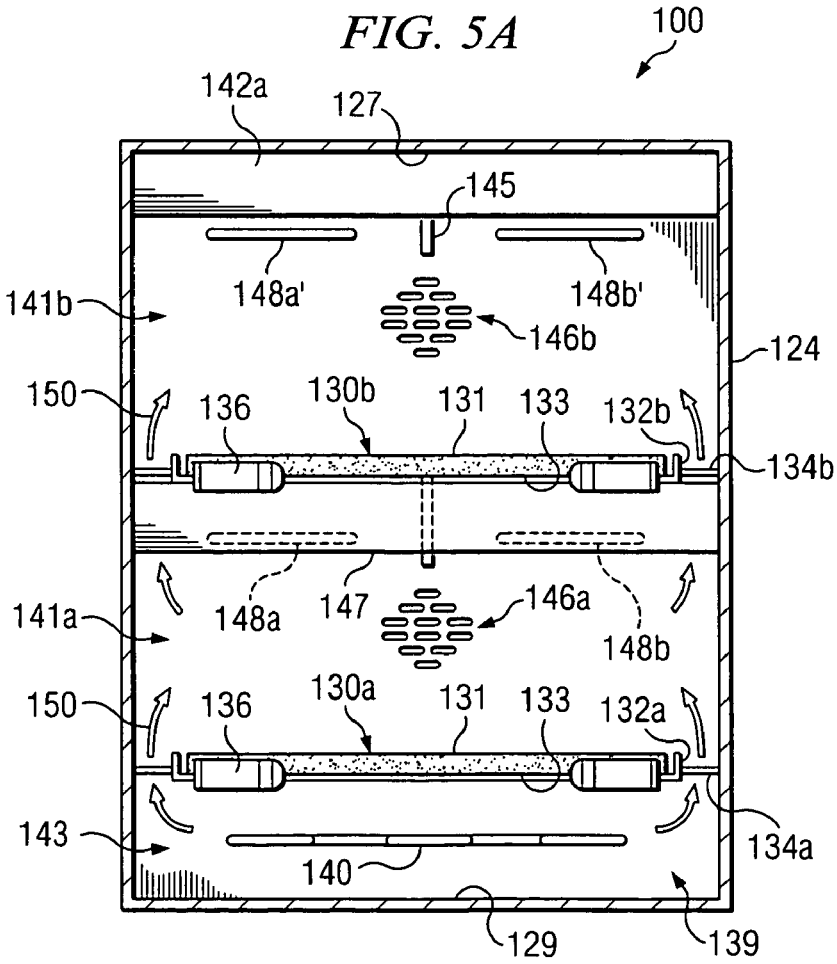
FIG. 5A is a sectional front view of an alternate implementation of an oven.
Figure 5B:
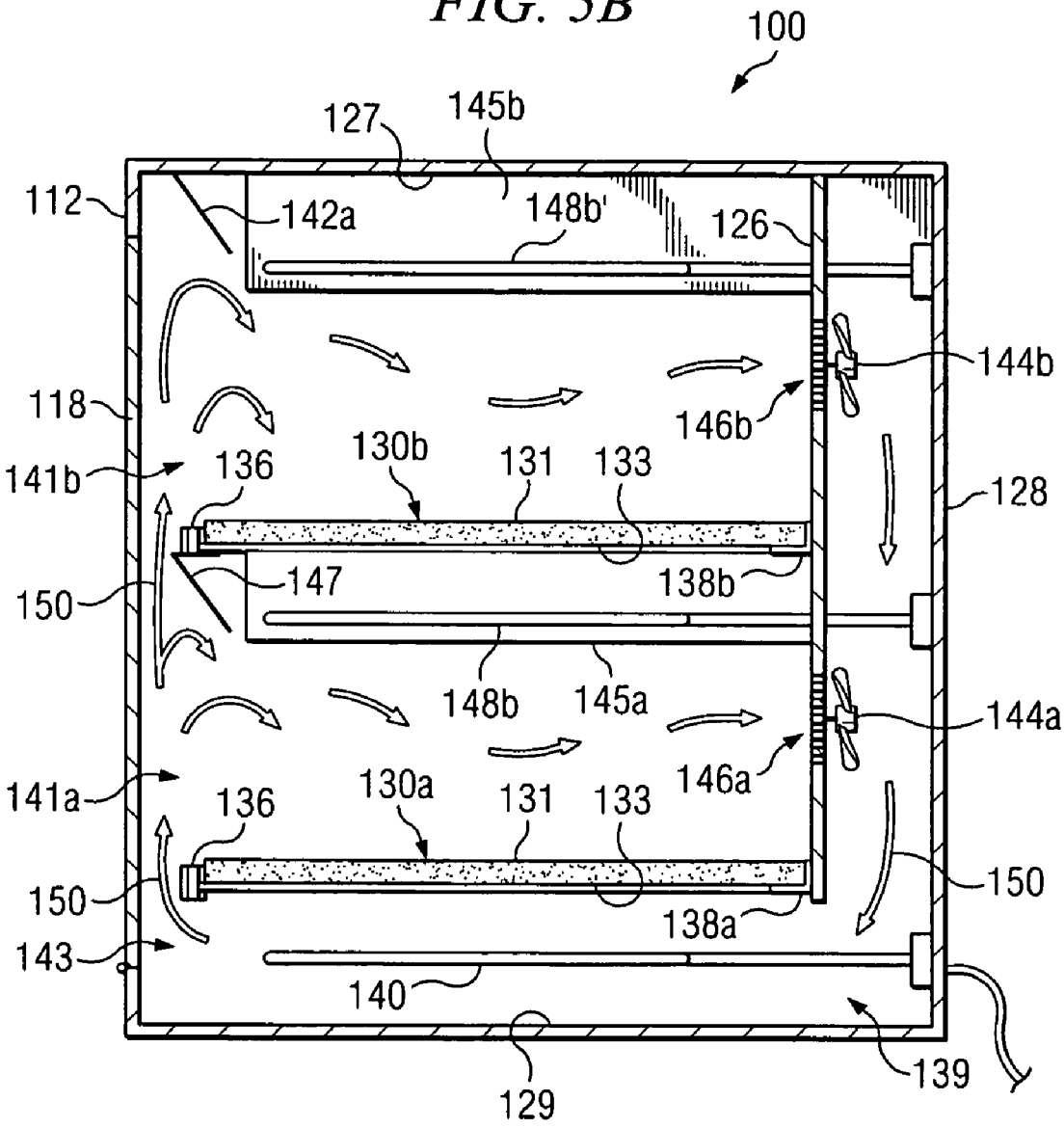
FIG. 5B is a sectional side view of the alternate implementation illustrated in FIG. 5A.

FIGS. 5A and 5B illustrate an alternative implementation of an oven 100. Reference numerals 100 to 150 in FIGS. 5A and 5B generally correspond with reference numerals 10-50 of FIGS. 1 through 4. The oven 100 includes multiple solid cooking surfaces 130, and multiple fans 144. The oven 100 also includes a door or front 118, a back 128, side walls 124, a ceiling 127 and a floor 129. Support pins 134 may be coupled to the side walls 124 to support side brackets 132. Side brackets 132 provide a support platform upon which the solid cooking surfaces 130 may be placed. Rear shelf 138 may be coupled to the side walls 124 and/or the rear divider 126 to provide additional support for the solid cooking surface and/or to prevent convection airflow from passing between the solid cooking surfaces 130 and the rear divider 126. The oven 100 has an oven interior 139 that includes a lower interior portion 143 and upper interior portions 141*a* and 141*b*.

Solid cooking surfaces 130 include a lower solid cooking surface 131*a* and an upper solid cooking surface 131*b*. Accordingly, side brackets 132*a* and 132*b*, support pins 134*a* and 134*b*, longitudinal deflectors 145*a* and 145*b* and upper heating elements 148 and 148' correspond to upper interior portions 141*a* and 141*b*, respectively. The two upper interior portions 141*a* and 141*b* each comprise a separate cooking environment. The upper interior portion 141*a* is located between the upper interior portion 141*b* and the lower interior portion 143. The multiple interior portions 141*a* and 141*b* allow for multiple food items to be cooked at different temperatures and for varying durations relative to each other. Fans 144*a* and 144*b* correspond with upper interior portions 141*a* and 141*b*, and solid cooking surfaces 130*a* and 130*b*, respectively.

During operations, fans 144*a* and 144*b* draw air from upper interior portions 141*a* and 141*b* through fan inlets or vents 146*a* and 146*b*, respectively. The airflow generated by fans 144*a* and 144*b* is depicted in FIGS. 5A and 5B by arrows 150. After the air is drawn through the vents 146, it is forced downward between the rear divider 126 and the interior back wall 128 to the lower interior portion 143. As the air continues to move through the lower interior portion 143, it is heated by lower heating element 140. A portion of the airflow will be forced upward, passing between the side walls 124 and the side brackets 132*a* and 132*b*. A remaining portion of the airflow 150 is divided between the upper interior portion 141*a* and the upper interior portion 141*b*. Upper deflectors 147 and 142*a* deflect portions of the airflow 150 into the upper interior portions 141*a* and 141*b*, respectively, to ensure uniform heating of the top surfaces 131*a* and 131*b* of the solid cooking surfaces 130*a* and 130*b*.

Longitudinal deflectors 145*a* and 145*b* may be disposed between the upper heating elements 148 and between the upper heating elements 148' to provide deflection of radiant heat. The upper deflectors 145*a* and 145*b* provide for different food types to be cooked on different portions of the solid cooking surfaces 130*a* and 130*b*. For example, some food items may be thicker and require a longer cooking time at a lower temperature than other, thinner food items.

By way of example only, and not by way of limitation, a calzone may be thicker, and thus require a longer cook time than a thinner food item, such as a pizza. If both a calzone and a pizza are placed on the solid cooking surface 130*a* for simultaneous cooking, each food item may require a different temperature for cooking. Accordingly, the upper heating elements 148*a* and 148*b* may radiate at differing temperatures to provide the variance. The longitudinal deflector 145*a* limits the amount of radiant heat produced by upper heating element 148*a* from that has an effect on the temperature of the upper interior portion 141*a* between the upper heating element 148*b* and the portion of the solid cooking surface 130*a* below the upper heating element 148*b*, and vice versa.

The operation of heating elements 40, 140 and 48, 148 are discussed in more detail in U.S. Pat. No. 6,114,663, U.S. Pat. No. 6,355,914, and U.S. patent application Ser. No. 10/077,250, all incorporated herein by reference. In addition to the disclosure therein, it is notable that the circulation of airflow will allow the lower heating elements 40, 140 to maintain a suitable non-cooking temperature of the solid cooking surface and the air in the oven. Upon operation as explained in the above publications, the upper heating elements 48, 148, which may be one or more heating elements, will be heated to provide a browning effect on the food to be cooked and will also continue to heat the air being circulated. Thus the lower heating elements 40 and 140 may be limited to stand by heating of the ovens 10 and 100, respectively. In operation this allows for very lower power consumption in stand by mode, which is desirable.

A single embodiment of the invention has been described. Nevertheless, it will be understood that various modifications may be made without departing from the spirit and scope of the invention. For example, a single upper heating element 48 or 148 may be used. Additionally or alternatively, multiple longitudinal deflectors 45 and 145 may be implemented, such that the number of longitudinal deflectors 45, 145 present equal one less than the number of upper heating elements 48, 148 to allow for more than two lateral cooking zones to be created using a single solid cooking surface 30, 130. Also, more than two upper interior portions 141 may be used in an implementation, thus allowing for multiple solid cooking surfaces 130 to be used. The multiple cooking zones could operate individually, alternatively, or simultaneously to cook food products in the ovens 10 and 100 in various implementations. Accordingly, other embodiments and implementations are within the scope of the following claims.

What is claimed is:

1. A food cooking oven comprising:

a front door, a back wall opposite the front door, an interior ceiling, an interior floor, and two side walls connecting the front door to the back wall and the ceiling to the floor;

a rear divider parallel to and spaced apart from the back wall, the rear divider running between the side walls and having a support shelf at a lower edge, the rear divider further having a fan inlet;

side brackets along each side wall;

a solid cooking surface having a top surface and a bottom surface, the solid cooking surface adapted to be supported by the support shelf on the lower edge of the rear divider and the side brackets;

a lower heating element positioned below the solid cooking surface and spaced evenly from the solid cooking surface;

a fan positioned between the rear divider and the back wall, the fan adapted to draw air through the fan inlet and push the air onto the lower cooking element.

2. The oven of claim 1, wherein the side brackets are adapted to substantially prevent air from passing between the side brackets and the solid cooking surface.

3. The oven of claim 1, further comprising:

at least one upper heating element adapted to provide radiant heat to the top surface of the solid cooking surface.

4. The oven of claim 1 further comprising:

a lateral deflector positioned near a top edge of the front door, the deflector adapted to disrupt air flowing up near a front edge of the solid cooking surface so that the air heats food on the top of the solid cooking surface in a substantially even manner.

5. The oven of claim 4, wherein the lateral deflector extends between the two sidewalls.

6. The oven of claim 3, wherein the at least one upper heating element comprises at least two upper heating elements, the at least two upper heating elements disposed laterally above the top surface of the solid cooking surface.

7. The oven of claim 6, further comprising:

a longitudinal deflector disposed between the at least two upper heating elements, the longitudinal deflector adapted to deflect a portion of the heat generated by the at least two upper heating elements.

8. A food cooking oven comprising:

a solid cooking surface;

a lower heating element spaced apart from the solid food cooking surface;

a fan adapted to provide a flow of heated air on top of the solid food cooking surface;

a front oven wall comprising an oven door;

a gap formed between the front oven wall and a front edge of the solid cooking surface forming a pathway for the flow of heated air;

an oven ceiling disposed between two sidewalls, the oven ceiling intersecting the front wall; and a first deflector disposed between the sidewalls and secured to one of (a) the intersection of the front wall and the ceiling or (b) the ceiling proximate to the front wall, the first deflector operable to redirect the flow of heated air over the front edge of the solid cooking surface adjacent to the gap.

9. The oven of claim 8, further comprising:

side brackets adapted to hold the solid cooking surface above the lower heating element and to allow the flow of heated air on the sides of the solid cooking surface.

10. The oven of claim 9, wherein the side brackets are further adapted to substantially prevent air from passing between the side brackets and the solid cooking surface.

11. The oven of claim 8, further comprising:

at least one upper heating element disposed between the oven ceiling an the solid cooking surface.

12. The oven of claim 11, further comprising:

a second deflector disposed adjacent to the oven ceiling, wherein the second deflector is oriented substantially normal to the first deflector.

13. The oven of claim 12, wherein:

the at least one upper heating element comprises two upper heating elements, the two upper heating elements spaced laterally between the oven ceiling and the solid cooking surface; and the longitudinal deflector is disposed between the two upper heating elements, the longitudinal deflector adapted to deflect a portion of heat emitted by the upper heating elements.

14. The oven of claim 8, further comprising:

a rear divider between the fan and the solid cooking surface, the rear divider having a rear shelf adapted to prevent flow of heated air over the rear edge of the solid cooking surface.

15. The oven of claim 13, wherein the rear the rear divider further comprises:

a fan inlet adapted to allow airflow above the solid cooking surface to be drawn into the fan.

16. An oven comprising:

a housing, the housing having an interior portion that includes two sidewalls, a front, a back, an oven floor and an oven ceiling;

at least one solid cooking surface disposed within the interior portion, the solid cooking surface having a top surface and a bottom surface;

at least one lower heating element adapted to emit heat; the at least one lower heating element disposed proximate to the oven floor;

at least one upper heating element adapted to emit heat, the at least one upper heating element disposed proximate to the oven ceiling; and at least one fan disposed within the interior, the fan adapted to force air over the at least one lower heating element to create a convection airflow within the interior of the housing, wherein the at least one solid cooking surfaces comprises a first solid cooking surface and a second solid cooking surface, the first solid cooking surface disposed between the second solid cooking surface and the oven floor.

17. The oven of claim 16, further comprising:

a lower interior portion substantially bounded by the oven floor and the first solid cooking surface;

a first upper interior portion substantially bounded by the first solid cooking surface and the second solid cooking surface; and a second upper interior portion substantially bounded by the second solid cooking surface and the oven ceiling.

18. The oven of claim 17, further comprising:

a first lateral deflector disposed between the first solid cooking surface and the second solid cooking surface; and a second lateral deflector disposed between the oven ceiling and the second solid cooking surface, wherein the first lateral deflector is adapted to deflect convection airflow from the oven front to the first solid cooking surface, and wherein the second lateral deflector is adapted to deflect convection airflow from the oven front to the second solid cooking surface.

19. The oven of claim 17, further comprising:

a first set of side brackets spaced from the sidewalls, the first set of side brackets adapted to support the first solid cooking surface, and wherein the first side brackets are adapted to prevent convection airflow from passing between the first side brackets and the first solid cooking surface; and a second set of side brackets spaced from the sidewalls, the second set of side brackets adapted to support the second solid cooking surface, and wherein the second side brackets are adapted to prevent convection airflow from passing between the second side brackets and the second solid cooking surface.

20. The oven of claim 19, wherein the first side brackets and the second side brackets are coupled to the sidewalls by support pins.

21. The oven of claim 17, further comprising:

a rear divider disposed between the first and second solid cooking surfaces and the back of the housing; the rear divider including a first fan inlet and a second fan inlet, wherein the first fan inlet is disposed between the first and second solid cooking surfaces and adapted to draw air through the first upper interior portion, and wherein the second fan inlet is disposed between the second solid cooking surface and the oven ceiling to draw air through the second upper interior portion.

22. The oven of claim 19, wherein the at least one upper heating elements comprises:

a first upper heating element and a second upper heating element, the first upper heating element disposed in the first upper interior portion, and the second upper heating element is disposed in the second upper interior portion.

23. The oven of claim 21, wherein:

the first upper heating element comprises two first upper heating elements disposed laterally between the first solid cooking surface and the second solid cooking surface; and the second upper heating element comprises two second upper heating elements disposed laterally between the oven ceiling and the second solid cooking surface.

24. The oven of claim 22, further comprising:

a first longitudinal deflector disposed in the first upper interior portion between the two first upper heating elements and oriented substantially normal to the first lateral deflector, wherein the first longitudinal deflector is adapted to deflect a portion of the heat generated by the two first upper heating elements; and a second longitudinal deflector disposed in the second upper interior portion between the two second upper heating elements and substantially normal to the second lateral deflector, wherein the second longitudinal deflector is adapted to deflect a portion of the heat generated by the two second upper heating elements.

* * * * *

UNITED STATES PATENT AND TRADEMARK OFFICE

CERTIFICATE OF CORRECTION

PATENT NO. : 7,372,000 B2
APPLICATION NO. : 11/029754
DATED : May 13, 2008
INVENTOR(S) : Stockley It is certified that error appears in the above-identified patent and that said Letters Patent is hereby corrected as shown below:

On the cover page,

Item [*] Notice: Subject to any disclaimer, the term of this patent is extended or adjusted under 35 USC 154(b) by 309 days Delete the phrase "by 309 days" and insert -- by 356 days --

Signed and Sealed this

Twentieth Day of January, 2009

JON W. DUDAS
*Director of the United States Patent and Trademark Office*